US009216501B2

(12) United States Patent
Reichel

(10) Patent No.: US 9,216,501 B2
(45) Date of Patent: Dec. 22, 2015

(54) ELECTRO-HYDRAULIC PRESSING DEVICE

(71) Applicant: Volker Reichel, Neuss (DE)

(72) Inventor: Volker Reichel, Neuss (DE)

(73) Assignee: Novopress GmbH Pressen Und Presswerkzeuge & Co. KG, Nuess (DE)

( * ) Notice: Subject to any disclaimer, the term of this patent is extended or adjusted under 35 U.S.C. 154(b) by 0 days.

(21) Appl. No.: 14/364,892

(22) PCT Filed: Oct. 24, 2012

(86) PCT No.: PCT/EP2012/071040
§ 371 (c)(1),
(2) Date: Aug. 6, 2014

(87) PCT Pub. No.: WO2013/087279
PCT Pub. Date: Jun. 20, 2013

(65) Prior Publication Data

US 2015/0000369 A1 Jan. 1, 2015

(30) Foreign Application Priority Data

Dec. 17, 2011 (DE) ..... 20 2011 109 251 U

(51) Int. Cl.

| | |
|---|---|
| ***B21D 7/06*** | (2006.01) |
| ***B25B 27/14*** | (2006.01) |
| ***B25B 27/10*** | (2006.01) |
| ***H01R 43/042*** | (2006.01) |
| ***B25F 5/00*** | (2006.01) |

(52) U.S. Cl.
CPC ..... *B25B 27/146* (2013.01); *B25B 27/10* (2013.01); *B25F 5/005* (2013.01); *H01R 43/0428* (2013.01)

(58) Field of Classification Search
CPC ..... B25B 27/146; B25B 27/10; B25F 5/005; H01R 43/0428
USPC ..... 72/453.15
See application file for complete search history.

(56) References Cited

U.S. PATENT DOCUMENTS

| | | | | |
|---|---|---|---|---|
| 5,195,354 | A * | 3/1993 | Yasui et al. | 72/453.03 |
| 6,276,186 | B1 * | 8/2001 | Frenken | 72/453.15 |
| 6,718,870 | B1 * | 4/2004 | Frenken | 100/266 |
| 8,074,485 | B2 * | 12/2011 | College | 72/453.15 |

(Continued)

FOREIGN PATENT DOCUMENTS

| | | |
|---|---|---|
| DE | 19825160 A1 | 4/1999 |
| DE | 202004000215 UI | 4/2004 |

(Continued)

OTHER PUBLICATIONS

International Search Report dated Feb. 1, 2013 for PCT application No. PCT/EP2012/071040.

*Primary Examiner* — David B Jones
(74) *Attorney, Agent, or Firm* — Ohlandt, Greeley, Ruggiero & Perle, LLP

(57) ABSTRACT

An electro-hydraulic pressing device, which is particularly suitable for producing pipe joints by means of press fittings, has a pressure piston, which acts on pressing jaws. The pressure piston divides a pressure piston chamber into a pressure chamber and a rear chamber. A hydraulic pump for feeding hydraulic fluid from a reservoir is connected to the pressure chamber. A balance piston is arranged in the piston in addition to an overpressure valve. Up until a switch-off pressure is reached, i.e. throughout the pressing process, the balance piston closes a connection opening and a return flow channel.

14 Claims, 4 Drawing Sheets

(56) References Cited

U.S. PATENT DOCUMENTS

| | | | | |
|---|---|---|---|---|
| 8,656,574 | B2 * | 2/2014 | Frenken | 29/508 |
| 2007/0180887 | A1 * | 8/2007 | Frenken | 72/451 |
| 2010/0275672 | A1 * | 11/2010 | Frenken | 72/372 |

FOREIGN PATENT DOCUMENTS

| | | | |
|---|---|---|---|
| DE | 202006001889 | UI | 3/2007 |
| DE | 102006026552 | A1 | 12/2007 |
| DE | 202011109251 | U1 | 5/2013 |

* cited by examiner

ELECTRO-HYDRAULIC PRESSING DEVICE

BACKGROUND

1. Field of the Disclosure

The disclosure relates to an electro-hydraulic pressing device, particularly for producing tube connections by means of press fittings, and for producing crimp connections in electrical engineering.

2. Discussion of the Background Art

Such a pressing device, as described e.g. in DE 20 2004 000 215, comprises e.g. two pliers-like press jaws. These are actuated by an electro-hydraulic drive. For this purpose, a pressure piston is provided in a piston chamber, the pressure chamber of the pressure piston being connected to the hydraulic pump. In this arrangement, conveyance of fluid into the pressure chamber will cause the pressure piston to move. This will result in the closing of the press jaws, wherein the pressure piston, optionally via a roller head, will actuate the press jaws. Further, alternatively to pliers-like press means, also so-called press loops are known. These comprise a plurality of mutually articulated press jaws which will be laid e.g. around a press fitting for pressing the same. The opening of the press loop will be connected to a pressing device so that, by contracting the press loop, a press connection will be realized. The pressing device used herein is designed substantially corresponding to the pressing device described in DE 20 2004 000 215. Further, axial pressing devices are known, in which the pressure build-up is also generated electro-hydraulically for displacement of a pressure piston.

For pressure build-up in the pressure chamber, hydraulic fluid is conveyed into the pressure chamber by the hydraulic pump. Thereby, the pressure piston is moved and the pressing is performed. If the pressing has been performed in a reliable manner, a switch-off pressure in the pressure chamber at the end of the pressing. Once the switch-off pressure has been reached, the pressing process will be automatically terminated. This is achieved by provision of an overpressure valve in the pressure piston. Said valve can be e.g. a needle valve as described in DE 20 2004 000 215 which, when the defined switch-off pressure has been reached, will open a connection channel provided in the pressure piston. When the switch-off pressure has been reached, the piston of the overpressure valve will be advanced into the pressure piston against the force of a bias spring, thus causing fluid to flow from the pressure chamber through the connection channel into a rear chamber of the piston chamber opposite to the pressure chamber. In this process, fluid will laterally past the piston of the overpressure valve.

Further, in the flow channel connecting the hydraulic pump to the pressure chamber, a control valve is provided. When the switch-off pressure has been reached, the resultant opening of the overpressure valve will cause a change of the pressure in the pressure chamber and thus also in the connection channel between hydraulic pump and pressure chamber. This will result in a switching of the control valve, resulting in the opening of a return flow channel. The return flow channel connects the pressure chamber to the fluid reservoir. The control valve as described in DE 20 2004 000 215 is of such a design that, during the pressing process, fluid will be pumped by the hydraulic pump through a narrow channel provided in the valve piston of the control valve. When the switch-off pressure has been reached and the pressure in the pressure chamber is thus sinking, the spring-biased valve piston of the control valve will be displaced and thus will clear the return flow channel. The process of pressing the pressure piston back into the starting position is performed by a return spring arranged in the pressure chamber. Said spring, when performing its return movement, will press the fluid in the pressure chamber—through the return flow channel cleared by the control valve—into the reservoir. A disadvantage of the pressing device described in DE 20 2004 000 215 resides in that, for performing the pressing process, the hydraulic fluid has to be pumped through the opening in the control valve that is small in cross section. This adversely affects the efficiency. Further, openings having a small cross section are susceptible to contamination.

An electro-hydraulic pressing device is also known from DE 198 25 160. In this device, a needle valve is arranged in the return flow channel. When the switch-off pressure has been reached, this needle valve will be opened so that the hydraulic fluid will be pressed back from the pressure chamber into the reservoir with the aid of the return spring. The needle valve arranged in the return flow channel comprises a channel having a small diameter, which during the pressing process is closed by the valve needle. Since also this device is provided with a channel of small cross section through which the fluid has to be pressed, the efficiency of the pressing device according to DE 198 25 160 in the process of pressing back the pressure piston is low. Further, there is again the disadvantage that the narrow-sectioned channel provided in the needle valve is easily contaminated.

It is the object of the disclosure to provide an electro-hydraulic pressing device which is suited particularly for producing tube connections by means of press fittings, wherein this device has a high efficiency both when opening and when closing the press jaws.

SUMMARY

The electro-hydraulic pressing device according to the disclosure comprises a pressure piston acting on press jaws. Herein, the pressure piston can act on the press jaws directly or by means of intermediate elements, such as e.g. a roller head. Further, using a pressing device connected to a press loop, it is possible, via intermediate elements, to act on the press jaws, i.e. to close the press loop, in an indirect manner. Such electro-hydraulic pressing devices are suited particularly for producing tube connections by means of press fittings but also for crimping cable shoes and the like.

The pressure piston is arranged for displacement in a piston chamber, said piston chamber being divided, by the pressure piston, into a pressure chamber and a rear chamber. With the aid of a hydraulic pump, hydraulic fluid can be conveyed from a reservoir into the pressure chamber. This will result in a movement of the pressure piston, wherein the pressure in the pressure chamber will increase along with the progress of the pressing. In the rear chamber arranged opposite to the pressure chamber, a return spring is provided. This spring serves for urging the pressure piston back into its starting position after completion of the pressing. In the pressure piston, an overpressure valve is arranged which particularly is designed as a needle valve. When a working pressure is reached which is obtained in the pressure chamber when the pressing has been completed, the overpressure valve will open a connection channel arranged between the rear chamber and a piston interior. The channel herein can be guided laterally past a valve piston of the overpressure valve, as also described in DE 20 2004 000 215.

According to the disclosure, a balance piston is arranged in the piston interior. The balance piston is operative to open a connection opening to allow for the pressure piston to be pushed back into the starting position after pressing. In correspondence therewith, the connection opening is closed by the balance piston when, during the pressing process, the piston is being moved out of its starting position. The connection opening is arranged between the pressure chamber and the piston interior. Further, the balance piston closes a return flow channel until the switch-off pressure is reached. When the switch-off pressure has been reached, this will result in a movement of the balance piston whereby, on the one hand, the connection opening between the pressure chamber and the piston interior and, further, also the return flow channel will be opened.

Thus, the balance piston is arranged within the pressure piston and during the pressing process will be moved together with the pressure piston while, during the pressing process, no relative movement will occur between the balance piston and the pressure piston. This relative movement will occur only when the switch-off pressure has been reached. After the switch-off pressure has been reached and the resultant displacement of the balance piston, the pressure piston will be pushed back into its starting position by the return spring. In the process, the fluid that is present in the pressure chamber will flow through the connection opening into the return flow channel. Since the connection channel is preferably arranged in the pressure piston, a return flow of the fluid will occur through the pressure piston. Since, during the pressing process, the fluid will flow directly into the pressure chamber and since no valve is arranged in the flow path, the pressing process performed by the movement of the pressure piston during the pressing process can be achieved with high efficiency because the connection opening by which the balance piston can be closed does not need to be designed as a needle valve. Thereby, also contamination problems are avoided or at least reduced. When the switch-off pressure has been reached, the connection opening, preferably having a large cross section, will be opened by the balance piston, thus causing the working piston to automatically travel back into the rear end position and respectively starting position. Due to the provision of a large cross section, this can take place very quickly.

On the rear side of the balance piston, a pressure spring could be provided which during the pressing process will be urging the balance piston in the direction of the connection opening for closing the same. In a particularly preferred embodiment of the disclosure, this spring can be omitted or at least be designed as a weak, merely supporting spring. In this arrangement, the piston interior is connected to the pressure chamber via a supply channel. During the pressing process, fluid will flow through this supply channel into the piston interior onto the rear side of the balance piston and will push the latter into the connection opening and respectively into a valve seat surrounding the connection opening or against an edge of the connection opening. Since the supply channel is open during the entire pressing process, the pressure on the rear side of the balance piston will rise corresponding to the pressure increase in the pressure chamber. As a result, the balance piston will be pressed ever more tightly against the connection opening. This way, in spite of the increase of the pressure in the pressure chamber, a displacement of the balance piston caused by said pressure increase and a resultant opening of the connection opening are avoided.

A supportive measure for holding the balance piston by means of a spring arranged on the rear side of the balance piston can be entirely omitted particularly if the rear side of the balance piston comprises a pressure surface whose pressure-relevant cross section is larger than the opening cross section of the connection opening. This design of the ratios between the surface areas has the consequence that the force acting on the rear side of the balance piston is larger than the force acting on a front side of the balance piston closing the connection opening.

According to a further preferred embodiment of the pressing device of the disclosure, it is provided that, at the start of a pressing process, i.e. before the pressure piston will begin to move, a front side of the pressure piston is in abutment on a sealing seat of the piston chamber. Said front side is that front side of the pressure piston in which the connection opening is arranged. Said sealing seat surrounds the connection opening. Since, in this embodiment, the feeding of the hydraulic fluid to the pressure chamber takes place externally of said sealing seat, initially no force or merely a slight force will act on the balance piston surface closing the connection opening. Instead, initially, the pressure on the rear side of the balance piston will be increased, thus pressing the balance piston into the connection opening. As soon as the pressure piston starts moving and pressure is thus being built up at the front so side of the balance piston, the force built up at the rear side of the balance piston is already higher so that an unintended displacement of the balance piston with resultant unclosing of the connection opening is avoided.

Further, it is preferred that the pressure piston comprises a head element arranged in the pressure chamber. Preferably, the balance piston is arranged entirely or at least partially within the head element. The head element is designed to the effect that, at least partially, it is not in abutment on the inner side of the pressure chamber. As a result, particularly at the beginning of the pressing process, the hydraulic fluid flowing into the pressure chamber can flow past the head element and will first flow via the supply channel into the chamber provided behind the balance piston, so as to exert a corresponding force onto the rear side of the balance piston. Particularly, the head element is designed cylindrically corresponding to the pressure chamber and has a smaller diameter than the pressure chamber so that an annular gap is formed between the inner side of the pressure chamber and the head element.

Preferably, the return flow channel is arranged in such a manner that, in the opened state of the balance piston, it will connect the pressure chamber to the rear chamber. For this reason, the return flow channel is preferably provided in the pressure piston. In this manner, particularly, a compact design can be realized. Further, it is advantageous if the fluid that is flowing back into the reservoir when the piston is being pressed back, is conducted into the rear chamber since, preferably, the rear chamber is anyway connected to the reservoir. This is required because, during the pressing process, fluid which is present in the rear chamber will be pressed out of the rear chamber by the piston. This is performed by a return duct or channel which particularly is arranged in the housing of the pressing tool and which connects the rear chamber to the reservoir.

The connection channel which during the pressing process is closed by the overpressure valve is preferably arranged in a partition wall between the piston interior and a valve chamber. Thus, the overpressure valve is preferably arranged internally of the pressure piston. The valve chamber herein is that chamber in which the piston of the overpressure valve is arranged. When the connection channel is opened by displacement of the piston of the overpressure valve, the piston will be displaced into the valve chamber. Thereby, at least a small quantity of fluid will flow through the connection channel into the valve chamber and will preferably proceed from the valve chamber into the rear chamber. Herein, it is preferred that the fluid will laterally flow past the piston of the overpressure valve. For this purpose, the piston can comprise corresponding grooves or channels extending in the longitudinal direction or can be arranged with a correspondingly large tolerance or gap in this space. It is to be considered in this regard that, according to the disclosure, it is sufficient if merely a small quantity of fluid is flowing through the connection channel when the switch-off pressure is reached because, thereby, only the pressure in the interior has to be reduced so that the balance piston will be moved and the connection opening will be opened. As soon as the connection opening is open, a return flow of medium will occur from the pressure chamber via the return flow channel and preferably through the rear chamber into the reservoir. According to preferred embodiment, the overpressure valve is a needle valve so that a connection channel with small diameter can be provided. This is not of disadvantage herein because merely small quantities of fluid need flow through the connection channel and, therefore, neither the efficiency will be degraded nor a danger of clogging will arise.

Further, in the pressing tool of the disclosure, the provision of the balance piston makes it possible to switch off the hydraulic pump and respectively the electric motor driving the hydraulic pump also during the pressing process. In this situation, the working piston will remain at that the respective position wherein then, by renewed switch-on of the hydraulic pump, the pressing process can be continued. Thus, a so-called "inching operation" is possible. According to the disclosure, this is possible because the balance piston comprises a pressure surface whose pressure-effective cross-sectional area is larger than the opening cross section of the connection opening. Due to this differential surface, the balance piston will remain in the closed position also during an interruption of the pressing process.

BRIEF DESCRIPTION OF THE DRAWINGS

The disclosure will be explained in greater detail hereunder by way of a preferred embodiment with reference to the accompanying drawings. In the drawings.

DETAILED DESCRIPTION OF THE PREFERRED EMBODIMENT

Figure 1:
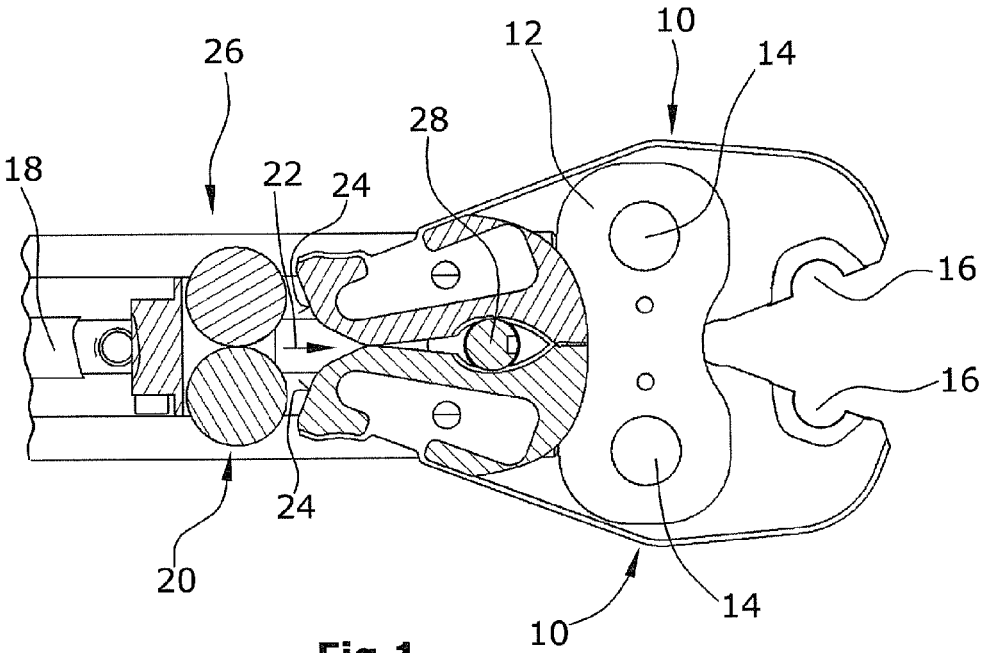
FIG. 1 shows a schematic plan view of a pressing tool.

In FIG. 1, the head area of a pliers-like pressing tool is schematically illustrated. Said head area comprises two press jaws 10 which are connected to each other by a connection element 12 and are pivotable about pins 14. In accordance with the respective design of the openings 16 on the two press jaws 14, a pressing of press fittings or other component parts can be performed. One can also use the recesses 16 or slightly differently designed recesses in order to connect these to the free end of the press loop and to then employ the pressing tool for contracting a press loop.

The closing of the press jaws 10 is carried out with the aid of a pressure piston 18 which preferably is driven electro-hydraulically. Pressure piston 18 is connected to a roller head 20. By displacement of pressure piston 18 and roller head 20 in the direction indicated by arrow 22, the rollers of roller head 20 will be moved into abutment on the flanks 24 of the press jaws 10 so that the—as viewed in FIG. 1—left-hand ends of the press jaws 10 will be pressed apart. Thereby, the press jaws will be pivoted about the pins 14 and the press jaws will thus be closed.

The press jaws 10 can be inserted into a housing 26 of the pressing tool and be fixed within the housing by a holding pin 28. Thus, the press jaws 10 are exchangeable so that, by use of the same pressing tool, different pressing jaws can be operated.

Figure 2:
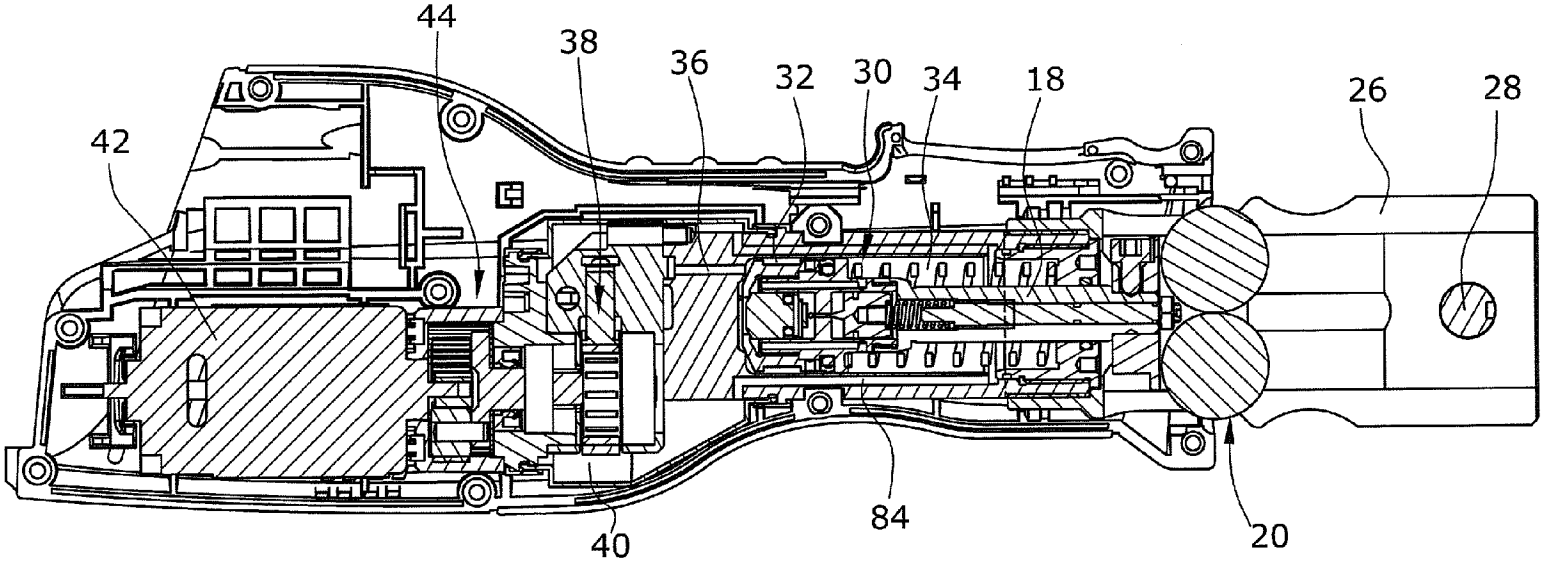
FIG. 2 shows a schematic longitudinal sectional view of a pressing tool according to a preferred embodiment.

In FIG. 2, the pressing tool is shown in longitudinal sectional view, without the press jaws 10 inserted into housing 26. The piston 18 is arranged in a piston chamber 30, wherein this pressure piston 18 divides the piston chamber 30 into a pressure chamber 32 and a rear chamber 34. Pressure chamber 32 is connected via a channel 36 to a hydraulic pump 38. Said hydraulic pump 38 is operative to convey hydraulic fluid from a reservoir 40 through channel 36 into pressure chamber 32. The hydraulic pump 38 is driven with the aid of a rechargeable battery 42 and an intermediate transmission 44.

Hereunder, the environment of piston 18 arranged in piston chamber 30 will be explained in greater detail with reference to FIGS. 3 and 4.

For subdivision of piston chamber 30 into said pressure chamber 32 and said rear chamber 34, the piston comprises a plate-shaped projection 46 which is sealed against an inner side 50 of piston chamber 30, particularly by additional use of an annular sealing element 48. Via channel 36, fluid is supplied into pressure chamber 32 so that the pressure in the chamber will be increased and, for performing a pressing process, piston 18 will be moved, from the starting position shown in FIG. 3, toward the right. After completion of the pressing process, pressure piston 18 will be moved back by a return spring 52 arranged in rear chamber 34.

In the illustrated embodiment, an overpressure valve 54 designed as a needle valve is arranged internally of piston 18. A valve piston 56 of overpressure valve 54 comprises a needle 58 which is operative to close a connection channel 60 as long as the switch-off pressure has not yet been reached. The closing of a connection channel 60 is effected by a pressure spring 62 whose bias can be set with the aid of a screw element 64.

In the interior of a head element 66 which is a part of piston 18, a balance piston 68 is arranged. Said balance piston 68 is displaceable within a piston interior 70. At the start of the pressing process and until the switch-off pressure is reached, balance piston 68 closes a connection opening 72 and a return flow channel 74 arranged in head element 66 and in piston 18.

Head element 66 comprises a sealing seat 76 at a front side of head element 66 arranged in pressure chamber 32. Said sealing seat 76 cooperates with an annular projection 78 provided on the inner side 50 of pressure chamber 32, thus forming a sealing surrounding the connection opening 72.

Further, a supply channel 80 is provided for the passage of fluid from pressure chamber 32 into the piston interior 70. The fluid entering the piston interior 70 via supply channel 80 will effect a pressure build-up in the piston interior 70, which will exert a force onto a rear side 82 of balance piston 68 that will cause the balance piston 68 to close the connection opening 72.

Further, the connection channel 60 of overpressure valve 54 is connected to piston interior 70. In the illustrated embodiment, rear chamber 34 is connected to reservoir 40 via two return ducts 84.

When the pressing process is started, hydraulic fluid is pumped through channel 36 into pressure chamber 32. Here, the fluid will first enter the annular gap between the head element 66 and the inner side 50 of pressure chamber 32. At first, due to the sealing seat 76, 78, no fluid or only small quantities of fluid will enter the area of connection opening 72. Instead, via supply channel 80, fluid will first reach the piston interior 70, causing a pressure build-up on the rear side 82 of balance piston 68. In this manner, the connection opening 72 will be safely closed by balance piston 68. Now, a movement of piston 18 will take place toward the right in FIG. 3. During this movement, the sealing seat 76, 78 will be released so that fluid will also flow in the area of the connection opening 72. However, since a pressure has already been built up in the piston interior 70, said fluid flow will not cause a displacement of balance piston 68 to the interior and thus will also not cause the connection opening 72 to be opened. Since, further, the effective pressure surface on the rear side of balance piston 68 is larger than the cross section of the connection opening 72, the force acting in the direction of connection opening 72 is larger than the counterforce generated by the pressure in pressure chamber 32, so that the connection opening 72 will be kept closed during the entire closing and pressing process.

After completion of the pressing process, i.e. as soon as the switch-off pressure in pressure chamber 32 has been reached, there will occur a displacement of valve piston 56 of overpressure valve 54 so that the needle 58 will be pulled out from connection channel 60 and will open the same. As a result, a small quantity of fluid will flow from the piston interior 70 through connection channel 60 into a valve chamber 86 where the piston 56 of overpressure valve 54 is displaceably arranged. From valve chamber 86, the fluid can flow laterally past the piston 56 and will enter the rear chamber 34 via transverse bores, not shown.

Opening the overpressure valve 54 will effect a pressure drop in the piston interior 70. Thereby, the force acting on the rear side 82 is reduced, so that the now distinctly higher pressure prevailing in pressure chamber 32 will displace the balance piston 68 into the interior of head element 66. Thereby, the connection opening 72 as well as the return flow channel 74 will be opened. Thus, hydraulic fluid can flow from pressure chamber 32 into rear chamber 34 via the connection opening 72 and the return flow channels 74 which are arranged in head element 66 and respectively piston 18.

Figure 4:
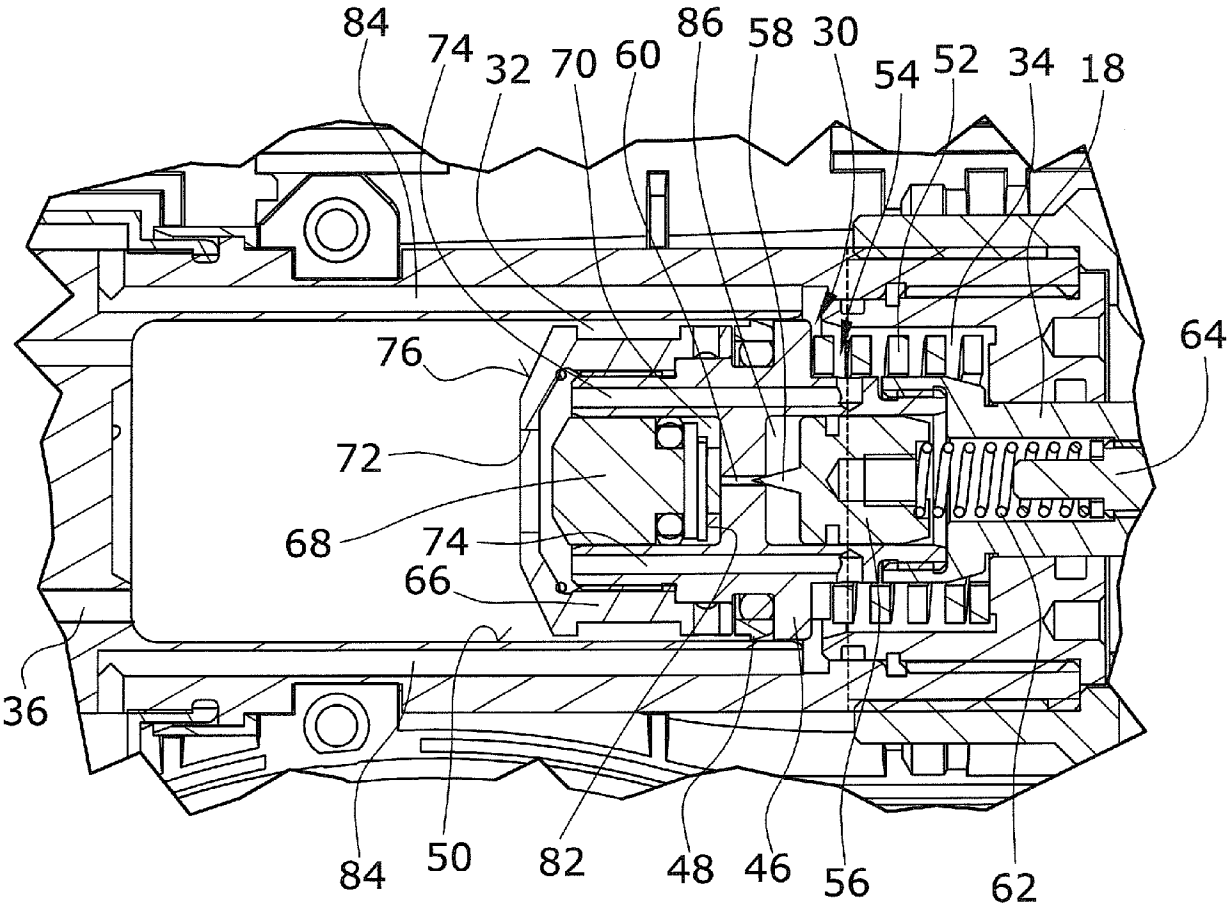
FIG. 4 shows a longitudinal sectional partial view of a pressure piston at the end of a pressing process.

Due to the resultant decreasing pressure in pressure chamber 32, the entire piston 18 will be moved by the return spring 52 toward the left in FIG. 4. Thereby, the fluid will be conveyed from pressure chamber 32 through connection opening 72 and the return flow channels 74 into rear chamber 34.

Figure 3:
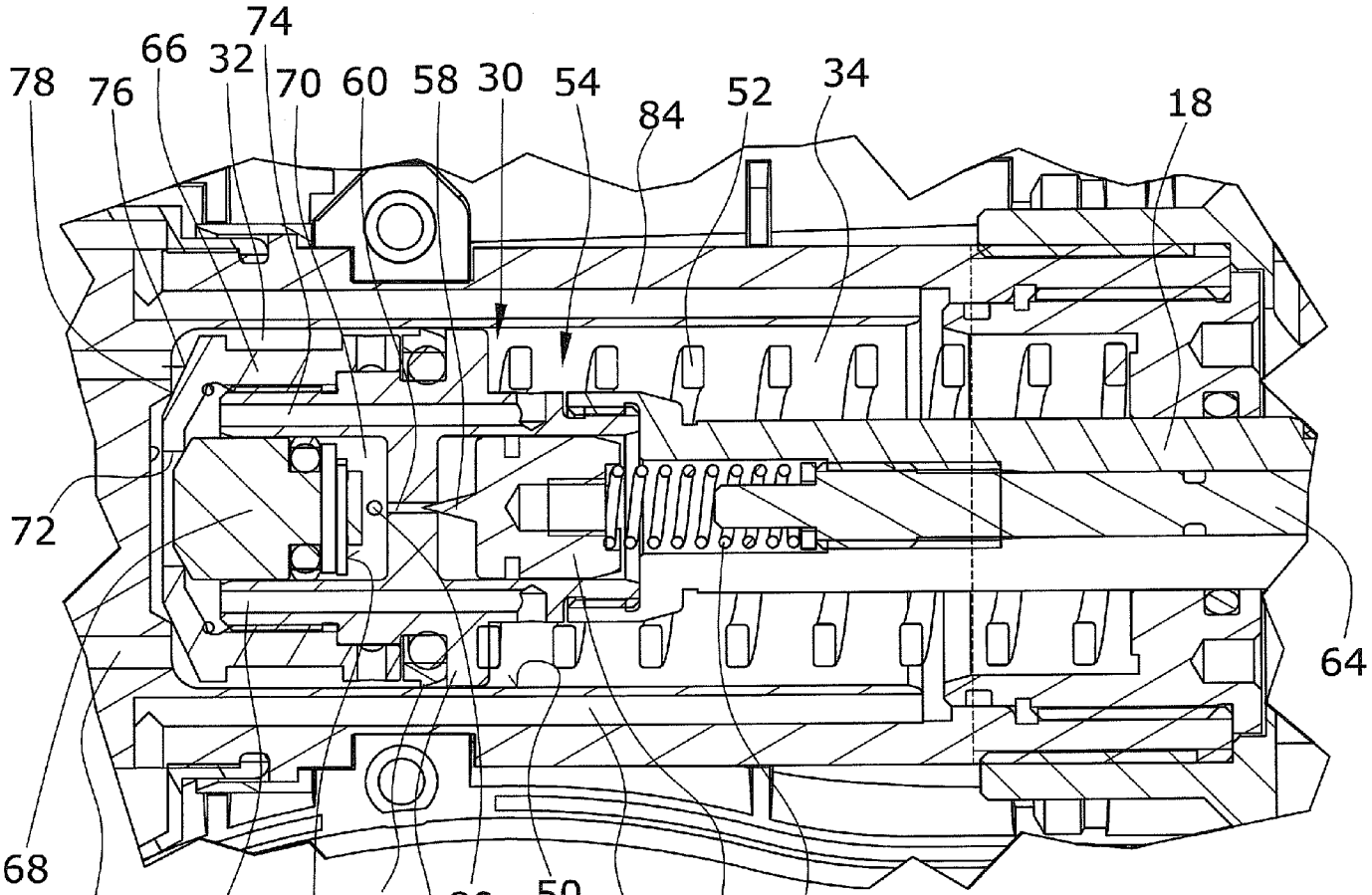
FIG. 3 shows a longitudinal sectional partial view of a pressure piston at the start of a pressing process.

As soon as the piston 18 has reached the position shown in FIG. 3, the pressing device is ready for the next pressing process. In this situation, the position of balance piston 68 may possibly not yet correspond to the position shown in FIG. 3. This position will, however, be ensured because, at the start of the next pressing process, hydraulic oil will first flow through supply conduit 80 into the piston interior 70.

During the pressing process, the hydraulic oil in rear chamber 34 will be pressed back again into the reservoir 40 via the return ducts 84.

What is claimed is:

1. An electro-hydraulic pressing and crimping device for making a tube or crimp connection by moving oppositely disposed press jaws reciprocally toward and away from each other, the pressing and crimping device comprising:

a pressure piston comprising a head element and a valve chamber, wherein the head element provides a piston interior and a sealing seat;

a piston chamber, wherein the pressure piston is disposed in the piston chamber, and wherein the pressure piston divides the piston chamber into a pressure chamber and a return chamber;

a hydraulic fluid reservoir;

a hydraulic pump disposed in communication with the hydraulic fluid reservoir, wherein the hydraulic pump conveys hydraulic fluid from the hydraulic fluid reservoir into the pressure chamber, wherein the hydraulic fluid entering the pressure chamber moves the pressure piston toward the press jaws, and wherein the movement of the pressure piston toward the press jaws moves the press jaws reciprocally towards each other to effect pressing and crimping of the tube or crimp connection;

a return spring disposed in the return chamber, wherein the return spring reverses movement of the pressure piston after a switch-off pressure indicating completion of the pressing and crimping operation has been reached;

a connection channel that provides fluid communication between the piston interior and the valve chamber;

an overpressure valve disposed in the valve chamber, wherein the overpressure valve comprises a needle that is moveably disposed in relation to the connection channel, wherein the needle closes the connection channel during the pressing and crimping operation and opens the connection channel when the switch-off pressure has been reached;

a connection opening disposed in fluid communication between the pressure chamber and the piston interior;

a return flow channel disposed in fluid communication between the pressure chamber and the rear chamber; and a balance piston having a front side proximal the connection opening and a rear side distal the connection opening, wherein the front side closes the connection opening and the return flow channel until the switch-off pressure has been reached.

2. The electro-hydraulic pressing device according to claim 1, wherein the piston interior is connected via a supply channel to the pressure chamber so that the rear side of the balance piston is subjected to a working pressure generated by the hydraulic pump until the switch-off pressure has been reached.

3. The electro-hydraulic pressing device according to claim 2, wherein the rear side of the balance piston has a cross section larger than the cross section of the connection opening.

4. The electro-hydraulic pressing device according to claim 1, wherein the front side of the pressure piston is in abutment on the sealing seat prior to a pressure build up in the pressure chamber.

5. The electro-hydraulic pressing device according to claim 1, wherein the sealing seat provided by the head element is formed by portions of the head element disposed into the piston interior.

6. The electro-hydraulic pressing device according to claim 1, wherein the return flow channel connects the pressure chamber to the return chamber when the front side of the balance piston is disposed away from the connection opening.

7. The electro-hydraulic pressing device according to claim 1, further comprising a return duct that connects the return chamber to the hydraulic fluid reservoir.

8. The electro-hydraulic pressing device according to claim 1, wherein the connection channel is disposed in a separating wall between the piston interior and a valve chamber.

9. The electro-hydraulic pressing device according to claim 1, wherein the needle is disposed on a valve piston of the overpressure valve.

10. The electro-hydraulic pressing device according to claim 1, wherein the front side of the balance piston opens the connection opening and the pressure piston automatically moves away from the press jaws to stop the pressing and crimping of the tube or crimp connection.

11. The electro-hydraulic pressing device according to claim 1, wherein, in case of an interruption of the conveyance of hydraulic fluid, the pressure piston will not change position.

12. The electro-hydraulic pressing device according to claim 1, wherein the connection opening is disposed in the head element.

13. The electro-hydraulic pressing device according to claim 1, wherein the return flow channel is disposed in the piston.

14. The electro-hydraulic pressing device according to claim 1, wherein the balance piston is disposed in the piston interior.

* * * * *